United States Patent [19]

Haas, Jr.

[11] 3,995,079

[45] Nov. 30, 1976

[54] ARTIFICIAL TURF-LIKE PRODUCT

[76] Inventor: Frederick T. Haas, Jr., 147 E. Oakridge Park, Metairie, La. 70055

[22] Filed: Dec. 26, 1973

[21] Appl. No.: 427,637

Related U.S. Application Data

[63] Continuation-in-part of Ser. No. 848,592, Aug. 8, 1969, abandoned.

[52] U.S. Cl. ..... 428/17; 273/195 A; 273/196; 273/198; 428/87

[51] Int. Cl.[2] ..... A01N 3/00; A41G 1/00

[58] Field of Search ..... 161/62–67, 161/21, 158, 162; 273/195, 196, 198; 252/88; 428/17, 85, 87, 96

[56] References Cited

UNITED STATES PATENTS 3,332,828 7/1967 Faria et al. ..... 161/62

OTHER PUBLICATIONS

"Turf Management", H. Burton Musser, McGraw Hill Book Co., 1962, pp. 166 and 167.

"Turf for Golf Courses", Piper et al., pp. 20, 32, 33, 146, 160, 235 (1923).

*Primary Examiner*—Marion E. McCamish

*Attorney, Agent, or Firm*—Schuyler, Birch, Swindler, McKie & Beckett

[57] ABSTRACT

An artificial turf-like product having a surface which exhibits game playing characteristics approaching those of natural turf is provided by interspersing a layer of non-compacting granular material comprising irregular angular particles having a size in the range from 6 to 100 U.S. screen mesh size, preferably from 12 to 50 among the upstanding pile elements of a synthetic pile fabric.

10 Claims, 5 Drawing Figures

FIG. 4
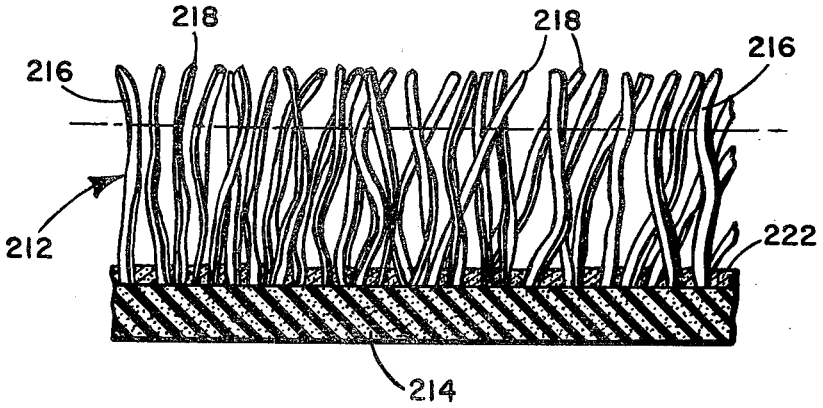
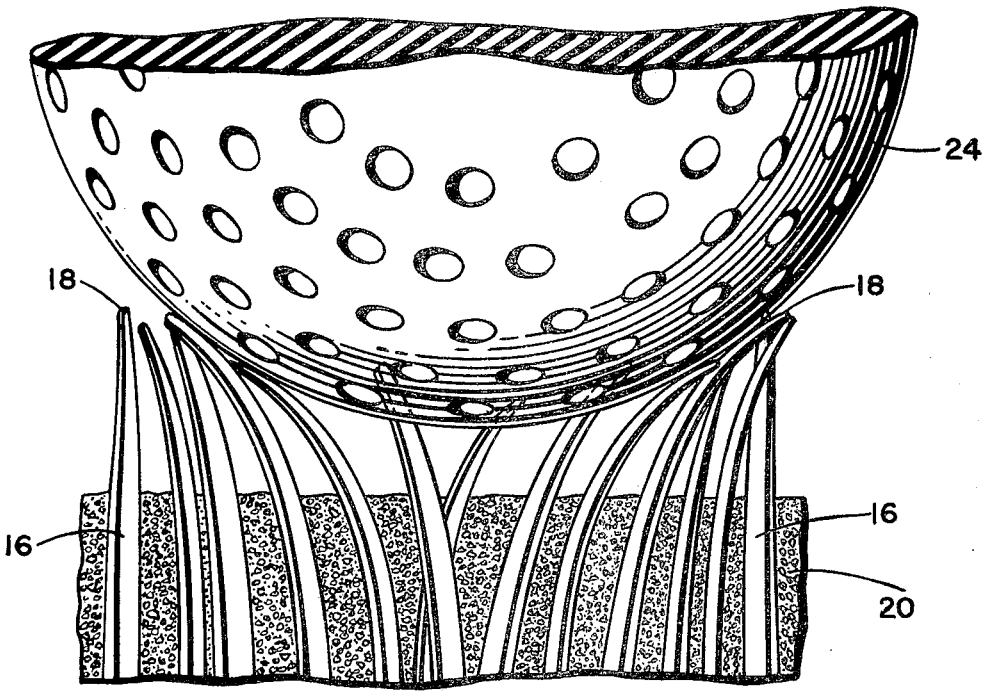
FIG. 5

ARTIFICIAL TURF-LIKE PRODUCT

This application is a continuation-in-part of my prior co-pending application Ser. No. 848,592 filed Aug. 8, 1969, abandoned as of the filing date accorded this application.

BACKGROUND OF THE INVENTION

1. Field of the Invention

This invention relates to a synthetic turf-like product providing a surface resembling grass and in particular to such a product characterized by game-playing characteristics substantially equivalent to those displayed by real turf.

2. Description of the Prior Art

Many outdoor games such as football, baseball, tennis and golf, are played on grass covered surfaces. In each case it is desirable to carefully maintain and manicure the surface so that proper playing conditions are provided.

Golf greens, in particular, are extremely difficult to maintain to provide a proper putting surface while at the same time providing a surface which will properly hold an approach shot. Manifestly, it is necessary to mow golf greens often to properly maintain the putting surface. In addition, watering must be accomplished on a regular basis and top dressing must be regularly provided to supplement the underlying soil and thus improve the texture and structure of the green. From this it can be appreciated that the maintenance of a golf green, or of any grass covered playing surface for that matter, is a time consuming and expensive process subject always to the vagaries of weather and physical abuse.

Because of the foregoing, it has been suggested that artificial turf be provided to replace real turf and thereby substantially decrease maintenance costs. For example, the artificial turf disclosed in U.S. Pat. No. 3,332,828 has been utilized for covering football and baseball fields. It has also been suggested that this material would be useful as a golf green; however, in actual practice, golf balls bounce too high upon impacting with the material. Further, it has been found that the backspin does not take sufficiently on such material to stop a golf ball on an approach shot. That is to say in golf parlance that the artificial turf such as that disclosed in U.S. Pat. No. 3,332,828 does not "hold" the ball and does not possess proper ball management characteristics. Also, the pile elements of the artificial turf have a tendency to lay down in various directions which produces a surface condition generally referred to as graininess which is not conducive to the best conditions for game playing. A golf ball putted on a grainy green of artificial turf of the type disclosed in U.S. Pat. No. 3,332,828 will not roll true because of the lay pile elements. The direction of bounce of a golf ball arriving on a grainy artificial turf green may vary somewhat depending on the lay of the pile elements.

Analogous shortcomings have also been present where such artificial turfs have been used for other game playing surfaces. That is to say, without expensive under surface preparation, and sometimes even with such preparation, prior art artificial game playing surfaces have been unable to appropriately absorb shock or provide adequate footing and as a result have provided unrealistic conditions conducive to player injuries and poor playing results.

SUMMARY OF THE INVENTION

Accordingly, the primary and principal object of the present invention is to provide a synthetic turf-like product which provides a game playing surface having game playing characteristics which are superior to previously known artificial turfs. Further, it is an aim of the invention to provide such a product which has game playing characteristics substantially equal to or superior to natural turf.

The foregoing objects, aims and purposes are substantially realized and the problems and difficulties of the prior art as set forth above generally have been solved through the use of a treated synthetic turf-like product which provides a game playing surface, closely resembling natural turf, particularly in its ability to absorb shock. The product comprises basically a pile fabric including a relatively flexible backing and normally generally upstanding pile elements which resemble grass and which have free ends spaced from the backing providing an upper game playing surface. In accordance with the invention the treated product additionally comprises a quantity of non-compacting granular material comprising irregular, angular particles having a U.S. screen mesh size between 6 and 100, interspersed on the backing and among the elements, said material being present in sufficient quantity to substantially absorb the shock of objects impacting thereon whereby to provide game playing characteristics approaching those of natural turf.

The pile elements and the interspersed granular material interact with each other to produce beneficial results. The granular material counteracts the tendency of the artificial turf to become grainy because of the pile elements laying down in various directions and stabilizes the pile elements in a generally upright position so that a ball will roll or bounce true on the playing surface. The pile elements stabilize the granular material against shifting under the influence of forces such as a ball impacting thereon or a player treading thereon or the force of water or windstorms which would cause plain uncompacted granular material to shift thereby rendering the surface of the playing area uneven. Shifting of the granular material is not absolutely prevented, but it is substantially retarded by the piles.

Uncompacted granular material without the piles would not be satisfactory because it would be unstable and would tend to shift thereby leaving a rough surface. Compacted granular material would be more stable but would not provide proper shock absorption.

The invention is of particular use as a golf green wherein the manageability of the ball on the synthetic green is enhanced by the presence of the required amount of the granular material. Specifically, the granular material should be present in sufficient quantity to provide a true putting surface and to substantially absorb the impact of a ball arriving on the green following an approach shot. Thus, the bounce of the ball is substantially reduced permitting the backspin of the ball to "hold" the ball on the green and provide the ball manageability heretofore obtainable only on expensively maintained natural turf.

BRIEF DESCRIPTION OF THE DRAWINGS

FIG. 4 is an enlarged cross sectional view similar to FIGS. 2 and 3 but illustrates a third embodiment of the invention wherein the pile elements are flocked onto a suitable backing.

DESCRIPTION OF THE PREFERRED EMBODIMENTS

Figure 1:
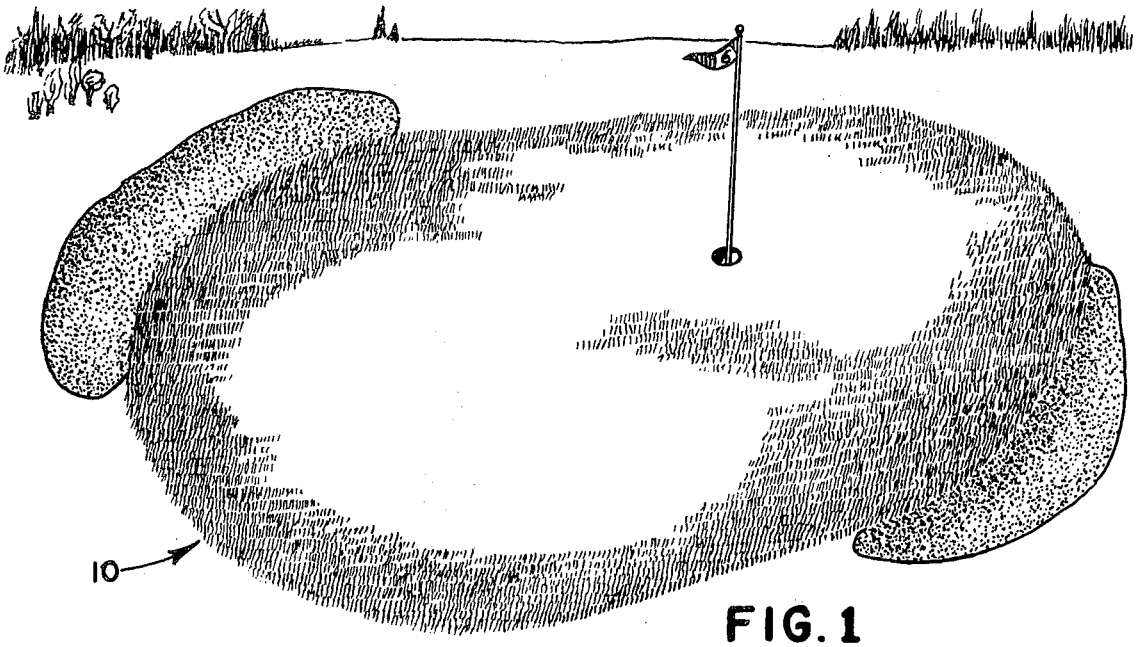
FIG. 1 is a perspective view illustrating the use of the turf-like product of the instant invention as a golf green.

A synthetic turf-like product which embodies the concepts and principles of the instant invention and which provides a game playing surface in accordance with the invention is illustrated in FIG. 1 and is therein designated broadly by the numeral 10. As illustrated, product 10 is particularly useful in providing a synthetic golf green. In this respect, the product is primarily useful in outdoor locations; however, it is to be understood that indoor usage also is contemplated, for example, in locations such as domed stadiums or under closed or open end roofing.

As used in FIG. 1 to provide a synthetic golf green, product 10 normally will be disposed in an undulating manner as is common for natural golf greens. On the other hand, it should be fully understood that the product also can be disposed to lie flat for use as a tennis court or to provide a covering for football gridirons or baseball fields.

Figure 2:
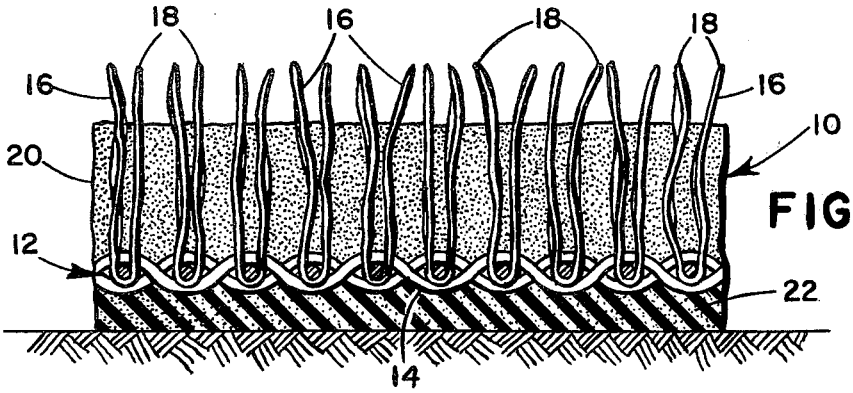
FIG. 2 is an enlarged cross sectional view illustrating a first embodiment of the invention wherein the pile elements of the fabric are woven or knitted integrally with the backing material.

In one of its preferred forms, as illustrated in FIG. 2 product 10 may comprise a pile fabric 12 which includes a relatively flexible backing 14 and a plurality of normally, generally upstanding pile elements 16. Elements 16 are configured to resemble grass and each has a free end 18 disposed in normally spaced relationship relative to backing 14. The ends 18 provide a grass-like upper surface having minimal graininess upon which a traveling ball will follow a relatively true course.

In the embodiment illustrated in FIG. 2, fabric 12 comprises a knitted or woven material. In this regard, elements 16 are initially woven or knitted as high loops at the time the fabric is produced. The loops are then subsequently cut to present ends 18. The threads of backing 14 are preferably weather resistant but may be any synthetic or natural material useful in the manufacture of carpets and the like. Elements 16 are preferably monofilaments which have been extruded from materials such as polyamides, polyesters, olefinic homopolymers such as polypropylene and copolymers such as filament forming copolymers. For example, any of the pile fabrics disclosed in Pat. No. 3,332,828 may be used for purposes of the present invention. In addition, it is to be understood that most any pile fabric may be utilized so long as it comprises normally upstanding pile elements providing an upper game playing surface capable of withstanding the action of the particular game being played thereon.

As shown in FIG. 2, product 10 also comprises a quantity of granular material 20 interspersed on backing 14 among elements 16. In my early experiments, ordinary fine river sand was interspersed among the pile elements and on the backing of a pile fabric resembling grass. While the sand initially gave enhanced shock absorbing characteristics to the artificial turf-like product, it was found that after a period of use and exposure to the weather, the sand tended to compact to form a dense, hard layer which did not provide the desired shock absorbing characteristics. Efforts to break up the layer of hard, compacted sand proved unacceptably expensive and indeed, at times resulted in damage to the underlying pile fabric.

I have now found that a layer of irregular, angular particulate material of a size lying between 6 and 100 on the U.S. screen mesh size scale not only provides shock absorbing characteristics approximating those of natural turf, but also when interspersed among the piles and on the backing of a pile fabric as described hereinabove, tends to be substantially non-compacting under the influence of the elements and the footsteps of innumerable golfers. Especially advantageous results are obtained when the U.S. mesh screen size of the granular particles is between 12 and 50, i.e. particles which pass through a 12 mesh screen and remain on a 50 mesh screen. The non-compacting granular material also counteracts the propensity of the piles to lay down and tends to stabilize the piles in an upright position so that graininess of the surface is minimized. The piles tend to stabilize the granular material against shifting and substantially retard wind or water erosion of the non-compacting material. Needless to say it is essential that the granular material not melt at temperatures to which the game playing surface will be subjected.

The best combination of proper shock absorption and resistance to compaction has been found when the particulate material comprises granulated coal slag. The coal slag is the residue of burned coal which has been heated to approximately 1200° to 1400° F. The resulting slag or clinker may be granulated by conventional means, e.g. a hammer mill. The output of the grinder is then screened to obtain the desired size fraction. The resulting dry, inorganic granular material is water insoluble, chemically inert and weather-resistant so that it will not undergo any detrimental changes after application to form a synthetic golf green according to the inventin. Particularly, the granulated slag has invention. or no tendency to absorb moisture. An analysis of the chemical composition of a typical granulated coal slag was as follows:

| | |
|---|---|
| Silicon Dioxide | 48% |
| Iron Oxide | 27% |
| Aluminum Oxide | 19% |
| Calcium Oxide | 4% |
| Magnesium Oxide | 1% |
| Titanium Oxide | 1% |

Naturally, there is some variation in the composition of slags produced from different coals.

It is not known precisely why the granulated coal slag is so resistant to compaction, but the compaction resistance is believed to be at least partially a result of the irregular, angular shape which the slag tends to assume when granulated and of the exclusion of very large and very small size particles. Granulated coal slag has been used on a synthetic golf green according to the invention for a period of six months without the occurrence of any significant adverse compaction.

Crushed granite and/or flint have similar non-compacting characteristics, but the use of granulated coal clag is preferred because of the availability of source material, which otherwise must be disposed of as a useless by-product of coal combustion.

Granular material 20 must always be present in sufficient quantity to substantially absorb the shock of an object impacting thereon. Further, particularly when product 10 is used as a golf green, material 20 must be present in sufficient quantity to substantially absorb the impact of a ball falling thereon whereby the bounce of the ball is substantially reduced. Incidentally, woven and knitted fabrics such as fabric 12 generally will be provided with an adhesive layer 22 disposed for maintaining elements 16 in place in the backing 14.

Figure 3:
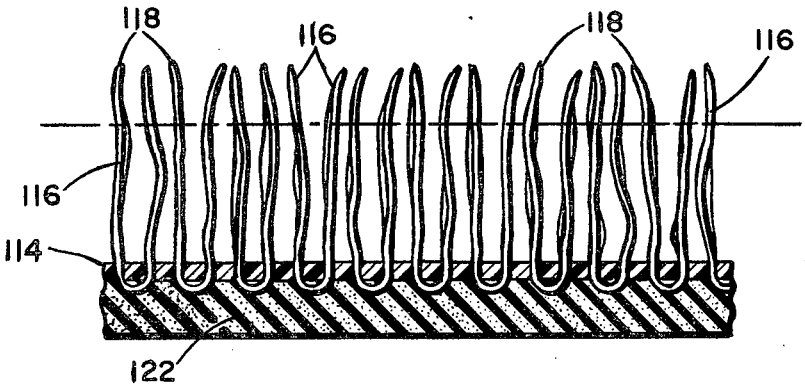
FIG. 3 is an enlarged cross sectional view similar to FIG. 2 but illustrates a second embodiment of the invention wherein the pile elements are tufted though the backing.

In the embodiment illustrated in FIG. 3, the pile elements 116 have been tufted through the backing 114 of a tufted fabric 112. In this embodiment, backing 114 preferably comprises sheet material, such as, for example, plastic or rubber or the like; however, it is to be understood that backing 114 could as well be a suitable woven or knitted material. Here again, a principal requirement is that the material be substantially weather resistant. The pile elements 116 of fabric 112 are held in position with an adhesive layer 122. The elements 116 of fabric 112 also have free ends 118 which serve the same purpose as the ends 18 of the elements 16 of fabric 12 shown in FIG. 2.

As a further alternative, a flocked fabric 212 such as that illustrated in FIG. 4 may be employed. Such a fabric will include a backing 214 which is preferably a plastic or rubber sheet, but which also may be a woven or knitted material and preferably is water resistant. This fabric 212 comprises pile elements 216 which have been flocked onto backing 214 and which are held in place on backing 214 by a layer of suitable adhesive 222 which is disposed on the upper surface of backing 214. As can be seen in FIG. 4, elements 216 present upper free ends 218 providing a grass-like upper surface. Ends 218, like ends 118 of elements 116, serve the same purpose as ends 18 of elements 16.

As has been mentioned above the backings 14, 114 and 214 should be preferably constructed of weather resistant material. In addition, backings 14, 114 and 214 should be of a nature to resist damage when subjected to spirited action with cleated or spiked shoes.

It is to be understood that the embodiments shown in FIGS. 3 and 4 will also include a quantity of granular material interspersed among the elements 116 and 216 respectively. This material, which has not been illustrated, desirably will be present to a level which coincides with or exceeds that indicated dashed lines 124 and 224 respectively up to nearly the full height of the pile.

Ideally, elements 16, 116 and 216 will comprise extruded monofilaments of 300 to 1200 denier. More importantly, and for purposes of providing a synthetic golf green the length of elements 16, 116 and 216 generally should be within the range of approximately ½ inch to 1½ inches. More specifically, it has been found that excellent playing characteristics are achieved when elements 16, 116 and 216 are within the range of approximately ¾ inch to 1 inch in length.

It has been found that when granulated coal slag is used as the granular material 20, the depth of the granulated slag should be within the range of from about 50% to substantially equal the length of elements 16, 116 and 216 depending on the application intended. The pile elements should extend at least to the surface of the granular material and sufficiently beyond that their color will be visible. Satisfactory golf practice greens result when the depth of the granular material is within one-sixty-fourth of an inch of the height of the pile elements. More particularly, when product 10 is being used as a synthetic golf green, it has been found that the depth of the granulated slag should preferably be in the range of approximately 75% to 99% of the length of the elements 16, 116 and 216, most preferably in the range of from 90% to 99% of the length of the pile elements. One particular embodiment which has been found to provide excellent ball control characteristics in a golf green combines a pile length of about 1 inch and a granular material depth of about fifteen-sixteenths inch. As will be readily understood by those skilled in the art, the depth of the granular material 20 and the length of the pile elements 16, 116 and 216 may depend somewhat on the characteristics of the pile elements or the granular material used. Thus, trial and error procedures may be necessary to achieve optimum results. That is, to arrive at conditions whereby the turf-like product provides game playing characteristics substantially identical with those of natural turf.

For football fields, the length of pile elements 16, 116 and 216 should be somewhat longer than for golf greens. This is desired to accommodate the typical football cleat for adequate footing and to provide adequate shock absorbing characteristics. For this case, elements 16, 116 and 216 may preferably be in the range of from 1½ inches to 2½ inches in length. The depth of material 20 will still preferably be approximately in the range of 75% to 95% of the length of the pile elements 16, 116 and 216.

The ends 18 of the elements 16 should be capable of being deflected slightly whenever a ball 24 is resting or rolling on the playing surface. This is desirable to provide game playing characteristics substantially identical to grass. The deflection of the ends 18 permits ball 24 to sink slightly beneath the normal level of the ends 18 until it encounters the granular material whereby movement of the ball is slightly resisted. Thus, the ball will behave as it does on grass rather than as it does on concrete or the like where no substantial resistance to movement would be encountered. When the elements 16 are of a material which resists deflection or when elements 16 have cross-sectional dimensions which resist deflection, it is desirable to taper ends 18 whereby ends 18 are pointed and the structural stability of elements 16 is decreased to the end that ends 18 may be deflected. Thus, ball 24 will sink slightly into the surface of the green until it rests on the granular material and will encounter slight resistance to movement.

The height of the granular material on the backing and among the pile elements will determine such important factors such as water retention of the playing field. The extent to which the pile elements project above the granular material will determine factors such as the speed of roll of a ball on the playing surface. For most sports, only a very slight projection of the pile above the granular material is necessary. For example, highly satisfactory golf greens may have pile which projects as little as one-sixty-fourth of an inch or less above the granular material.

From the foregoing it can be seen that the present invention provides a synthetic product having a grass-like playing surface which with optimum parameters exhibits excellent game playing and/or ball-control characteristics equal or superior to those of natural turf. The granular material counteracts the grainy tendency of the pile elements to lay down in various directions and tends to stabilize the piles in a normally upright position. The normally upright pile elements provide a surface upon which a ball will roll true. The granular material interspersed on the backing of the fabric among the pile elements unexpectedly operates to cause the fabric to exhibit excellent shock absorption characteristics. The pile elements tends to stabilize the non-compacted granular material against shifting which would result in a non-uniform playing surface. It has been found that a golf green constructed in accordance with this invention will properly take the backspin of the ball on approach shots to hold the ball on the green and will facilitate control over the movement of a putted ball by eliminating graininess. Thus, the playing surface obtained in accordance with the invention combines a good putting surface with real grass-like ball control capabilities. Moreover, maintenance expenditures are substantially eliminated by the present invention since the green may be maintained merely by periodically leveling the granular material by sweeping the surface with a broom or automatic sweeper agitator.

Since modifications of the foregoing example will undoubtedly occur to those skilled in the art, the scope of the invention is to be limited solely by the scope of the following claims.

I claim:

1. A synthetic turf-like product providing a game playing surface having characteristics approaching those of natural turf comprising:

a pile fabric including a relatively flexible backing and normally generally upstanding pile elements resembling grass; and a quantity of non-compacting granular material comprising irregular, angular particles having a size between 6 and 100 U.S. screen mesh size selected from the class consisting of granulated coal slag, crushed flint and crushed granite; said granular material being interspersed on the backing among the pile elements of said pile fabric to a depth sufficient to substantially absorb the shock of objects impacting thereon.

2. A synthetic golf green as recited in claim 1 wherein the length of said pile elements is in the range of from about ½ inch to about 1½ inches and the depth of said granular material is in the range of from about 50% to essentially equal the length of the pile elements.

3. A synthetic golf green as recited in claim 2 wherein the length of said pile elements is in the range of from about ¾ inch to about 1 inch and the depth of said granular material is in the range of from about 75% to about 99% of the length of the pile elements.

4. A synthetic golf green as recited in claim 3 wherein the depth of said granular material is in the range of from about 90% to about 99% of the length of the pile elements.

5. A golf green as recited in claim 1 wherein said granular material comprises irregular, angular particles having a U.S. screen mesh size between 12 and 50.

6. A golf green as recited in claim 1 wherein said granular material comprises irregular, angular particles having a U.S. screen mesh size between 12 and 50.

7. A golf green as recited in claim 1 wherein said granular material comprises granulated coal slag.

8. A golf green as recited in claim 1 wherein said granular material comprises irregular, angular particles having a size between 12 and 50 U.S. screen mesh size.

9. A golf green as recited in claim 1 wherein said granular material comprises crushed granite.

10. A golf green as recited in claim 1 wherein said granular material comprises crushed flint.

* * * * *